US008371812B2

(12) United States Patent
Manteiga et al.

(10) Patent No.: US 8,371,812 B2
(45) Date of Patent: Feb. 12, 2013

(54) TURBINE FRAME ASSEMBLY AND METHOD FOR A GAS TURBINE ENGINE

(75) Inventors: John Alan Manteiga, North Andover, MA (US); Robert John Parks, Ipswich, MA (US); Wilhelm Hernandez, Lynn, MA (US); Patrick Murphy, Kensington, NH (US)

(73) Assignee: General Electric Company, Schenectady, NY (US)

( * ) Notice: Subject to any disclaimer, the term of this patent is extended or adjusted under 35 U.S.C. 154(b) by 1048 days.

(21) Appl. No.: 12/325,174

(22) Filed: Nov. 29, 2008

(65) Prior Publication Data

US 2010/0132374 A1 Jun. 3, 2010

(51) Int. Cl.
*F03B 11/02* (2006.01)

(52) U.S. Cl. ..... 415/209.3; 415/115; 416/96 A

(58) Field of Classification Search ..... 415/115, 415/116, 209.2, 209.3; 416/93 R, 96 A, 97 R, 416/214 A, 244 R, 244 A
See application file for complete search history.

(56) References Cited

U.S. PATENT DOCUMENTS

| | | | | | |
|---|---|---|---|---|---|
| 2,961,150 | A | * | 11/1960 | Pirtle | 417/352 |
| 3,057,542 | A | * | 10/1962 | Keenan et al. | 415/180 |
| 4,321,007 | A | * | 3/1982 | Dennison et al. | 415/142 |
| 4,793,770 | A | * | 12/1988 | Schonewald et al. | 415/190 |
| 4,864,810 | A | * | 9/1989 | Hines | 60/775 |
| 5,020,318 | A | * | 6/1991 | Vdoviak | 60/226.1 |
| 5,272,869 | A | | 12/1993 | Dawson et al. | |
| 5,284,011 | A | | 2/1994 | Von Benken | |
| 5,292,227 | A | | 3/1994 | Czachor et al. | |
| 5,340,274 | A | * | 8/1994 | Cunha | 415/115 |
| 5,356,264 | A | | 10/1994 | Watson et al. | |
| 5,357,744 | A | | 10/1994 | Czachor et al. | |
| 5,438,756 | A | | 8/1995 | Halchak et al. | |
| 5,483,792 | A | | 1/1996 | Czachor et al. | |
| 5,634,767 | A | | 6/1997 | Dawson | |
| 5,851,105 | A | | 12/1998 | Fric et al. | |
| 6,183,192 | B1 | * | 2/2001 | Tressler et al. | 415/115 |
| 6,358,001 | B1 | | 3/2002 | Bosel et al. | |
| 6,439,841 | B1 | | 8/2002 | Bosel | |
| 6,447,248 | B1 | | 9/2002 | Kastl et al. | |
| 6,612,807 | B2 | | 9/2003 | Czachor | |
| 6,672,833 | B2 | | 1/2004 | MacLean et al. | |
| 6,708,482 | B2 | | 3/2004 | Seda | |
| 6,796,765 | B2 | | 9/2004 | Kosel et al. | |
| 6,860,716 | B2 | | 3/2005 | Czachor et al. | |
| 6,883,303 | B1 | | 4/2005 | Seda | |
| 6,935,837 | B2 | | 8/2005 | Moniz et al. | |
| 6,983,608 | B2 | | 1/2006 | Allen, Jr. et al. | |
| 7,353,647 | B2 | | 4/2008 | Orlando et al. | |
| 2007/0140849 | A1 | * | 6/2007 | Flodman et al. | 416/97 R |
| 2007/0234737 | A1 | * | 10/2007 | Vosberg | 60/785 |

* cited by examiner

*Primary Examiner* — Dwayne J White
(74) *Attorney, Agent, or Firm* — General Electric Company; David J. Clement; William Scott Andes

(57) ABSTRACT

A turbine frame assembly for a gas turbine engine includes: (a) a turbine frame including: (i) an outer ring; (ii) a hub; (ii) a plurality of struts extending between the hub and the outer ring; (b) a two-piece strut fairing surrounding each of the struts, including: (i) an inner band; (ii) an outer band; and (iii) an airfoil-shaped vane extending between the inner and outer bands; (d) a plurality of nozzle segments disposed between the outer ring and the hub, each nozzle segment being an integral metallic casting including: (i) an arcuate outer band; (ii) an arcuate inner band; and (ii) an airfoil-shaped vane.

16 Claims, 13 Drawing Sheets

TURBINE FRAME ASSEMBLY AND METHOD FOR A GAS TURBINE ENGINE

STATEMENT REGARDING FEDERALLY SPONSORED RESEARCH AND DEVELOPMENT

The U.S. Government may have certain rights in this invention pursuant to contract number N00019-06-C-0081 awarded by the Department of the Navy.

BACKGROUND OF THE INVENTION

This invention relates generally to gas turbine engine turbines and more particularly to structural members of such engines.

Gas turbine engines frequently include a stationary turbine frame (also referred to as an inter-turbine frame or turbine center frame) which provides a structural load path from bearings which support the rotating shafts of the engine to an outer casing, which forms a backbone structure of the engine. The turbine frame crosses the combustion gas flowpath of the turbine and is thus exposed to high temperatures in operation.

It is known to provide a multi-piece, passively cooled turbine frame, with actively cooled turbine nozzle vanes positioned downstream therefrom. It is also known to provide a one-piece, passively cooled turbine frame which integrates a passively cooled turbine nozzle cascade.

From a thermodynamic standpoint it is desirable to increase operating temperatures within gas turbine engines as much as possible to increase both output and efficiency. However, as engine operating temperatures are increased, increased active cooling for turbine frame, turbine nozzle, and turbine blade components becomes necessary.

To address these cooling needs it is further known to provide a high-temperature capable multi-piece turbine frame incorporating actively cooled fairings and flowpath panels, and utilizing turbine nozzle vanes made from advanced ceramic materials that do not require cooling.

However, none of these turbine frame configurations integrate a one-piece turbine frame construction with conventional-configuration actively cooled nozzles.

BRIEF SUMMARY OF THE INVENTION

These and other shortcomings of the prior art are addressed by the present invention, which provides a turbine frame assembly that incorporates a one-piece frame construction with actively cooled nozzles of a conventional cast metal construction.

According to one aspect, a turbine frame assembly for a gas turbine engine includes: (a) a turbine frame including: (i) an outer ring; (ii) a hub; (ii) a plurality of struts extending between the hub and the outer ring; (b) a two-piece strut fairing surrounding each of the struts, including: (i) an inner band; (ii) an outer band; and (iii) an airfoil-shaped vane extending between the inner and outer bands; (d) a plurality of nozzle segments disposed between the outer ring and the hub, each nozzle segment being an integral metallic casting including: (i) an arcuate outer band; (ii) an arcuate inner band; and (ii) an airfoil-shaped vane.

According to another aspect of the invention, a method of cooling a turbine frame assembly of a gas turbine engine includes: (a) providing a turbine frame having: (i) a outer ring; (ii) a hub; (ii) at least one strut extending between the hub and the outer ring and surrounded by an aerodynamic fairing; (b) providing a nozzle cascade disposed between the hub and the outer ring, comprising a plurality of airfoil-shaped vanes carried between segmented annular inner and outer bands; (c) directing cooling air radially inward through the struts to the hub; (d) passing the cooling air to an inner manifold located within the hub; and (c) passing the cooling air from the manifold to a turbine rotor disposed downstream of the hub.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
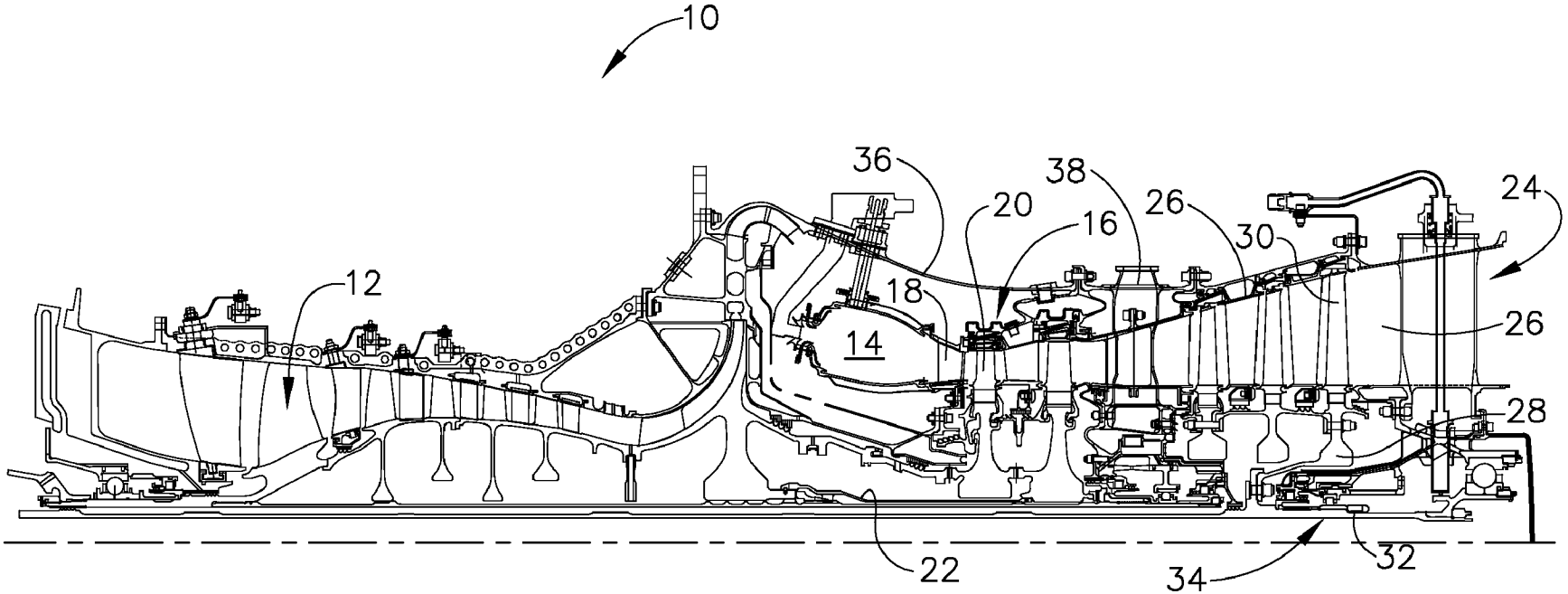
FIG. 1 a schematic half-sectional view of a gas turbine engine constructed in accordance with an aspect of the present invention.
Figure 2A:
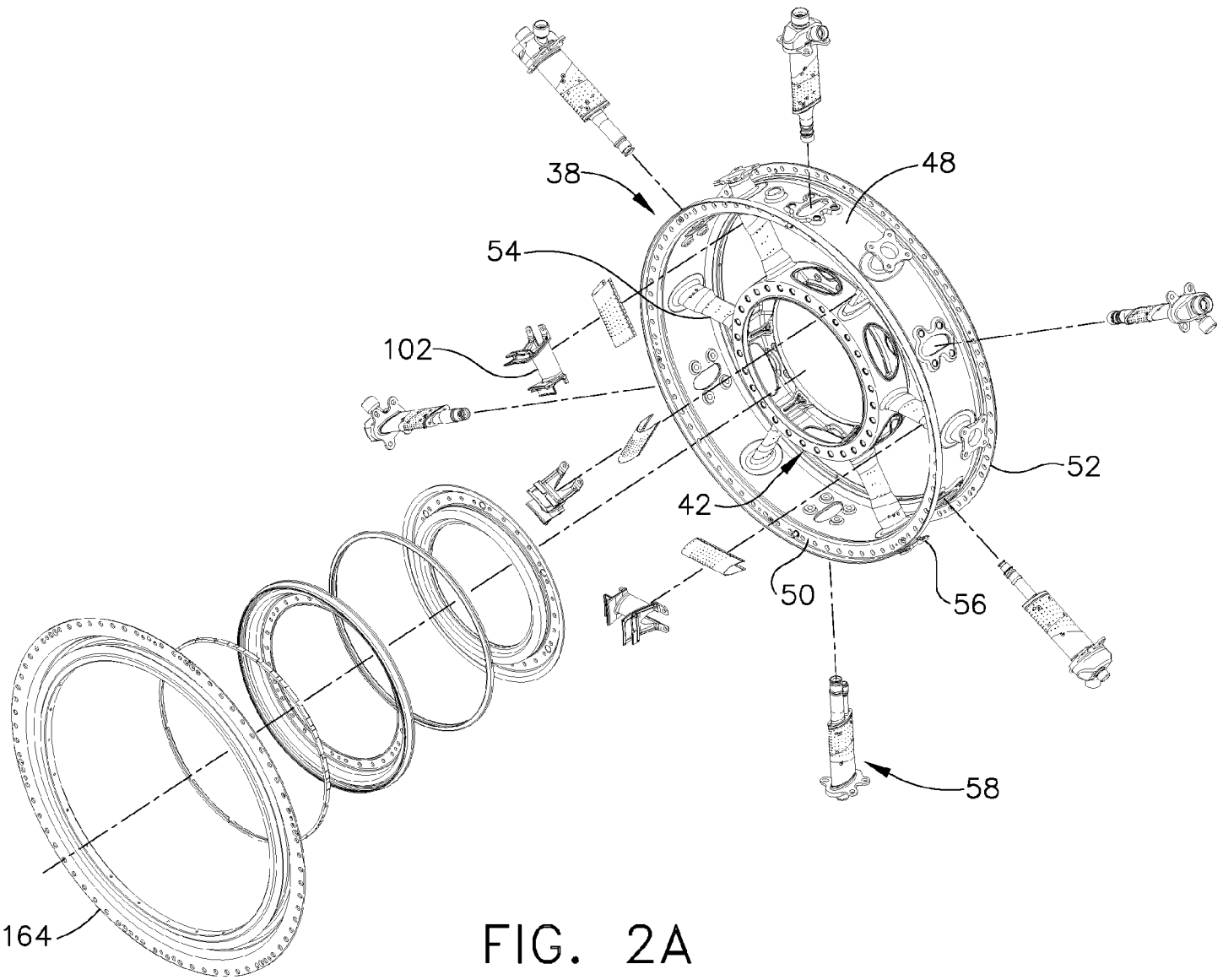
FIGS. 2A and 2B are an exploded perspective view of a turbine frame assembly of the gas turbine engine of FIG. 1.
Figure 2B:
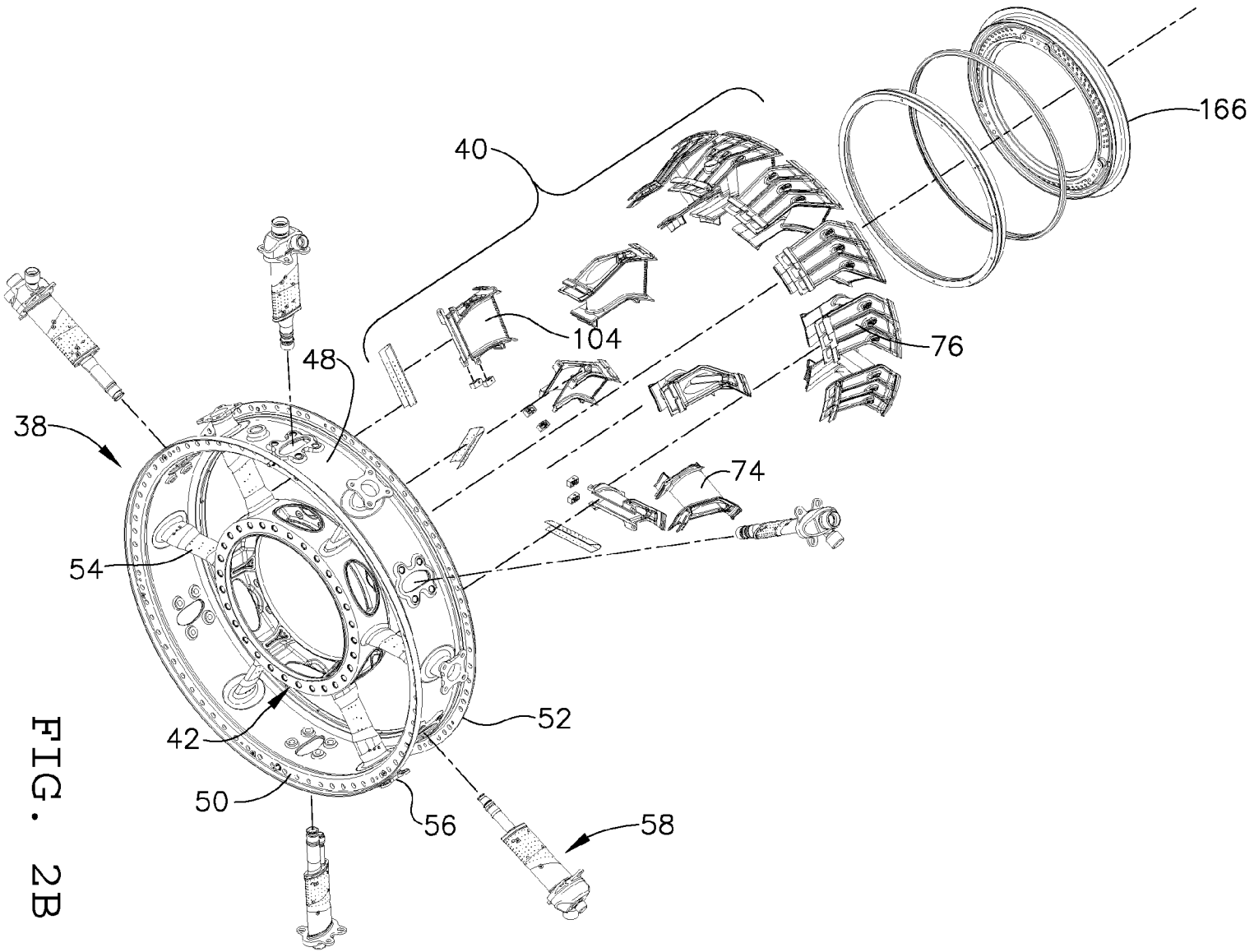

Referring to the drawings wherein identical reference numerals denote the same elements throughout the various views, FIGS. 1 and 2 depict a portion of a gas turbine engine 10 having, among other structures, a compressor 12, a combustor 14, and a gas generator turbine 16. In the illustrated example, the engine is a turboshaft engine. However, the principles described herein are equally applicable to turboprop, turbojet, and turbofan engines, as well as turbine engines used for other vehicles or in stationary applications.

The compressor 12 provides compressed air that passes into the combustor 14 where fuel is introduced and burned to generate hot combustion gases. The combustion gases are discharged to the gas generator turbine 16 which comprises alternating rows of stationary vanes or nozzles 18 and rotating blades or buckets 20. The combustion gases are expanded therein and energy is extracted to drive the compressor 12 through an outer shaft 22.

A work turbine 24 is disposed downstream of the gas generator turbine 16. It also comprises alternating rows of stationary vanes or nozzles 26 and rotors 28 carrying rotating blades or buckets 30. The work turbine 24 further expands the combustion gases and extracts energy to drive an external load (such as a propeller or gearbox) through an inner shaft 32.

The inner and outer shafts 32 and 22 are supported for rotation in one or more bearings 34. One or more turbine frames provide structural load paths from the bearings 34 to an outer casing 36, which forms a backbone structure of the engine 10. In particular, a turbine frame assembly, which comprises a turbine frame 38 that integrates a first stage nozzle cascade 40 of the work turbine 24, is disposed between the gas generator turbine 16 and the work turbine 24.

Figure 3A:
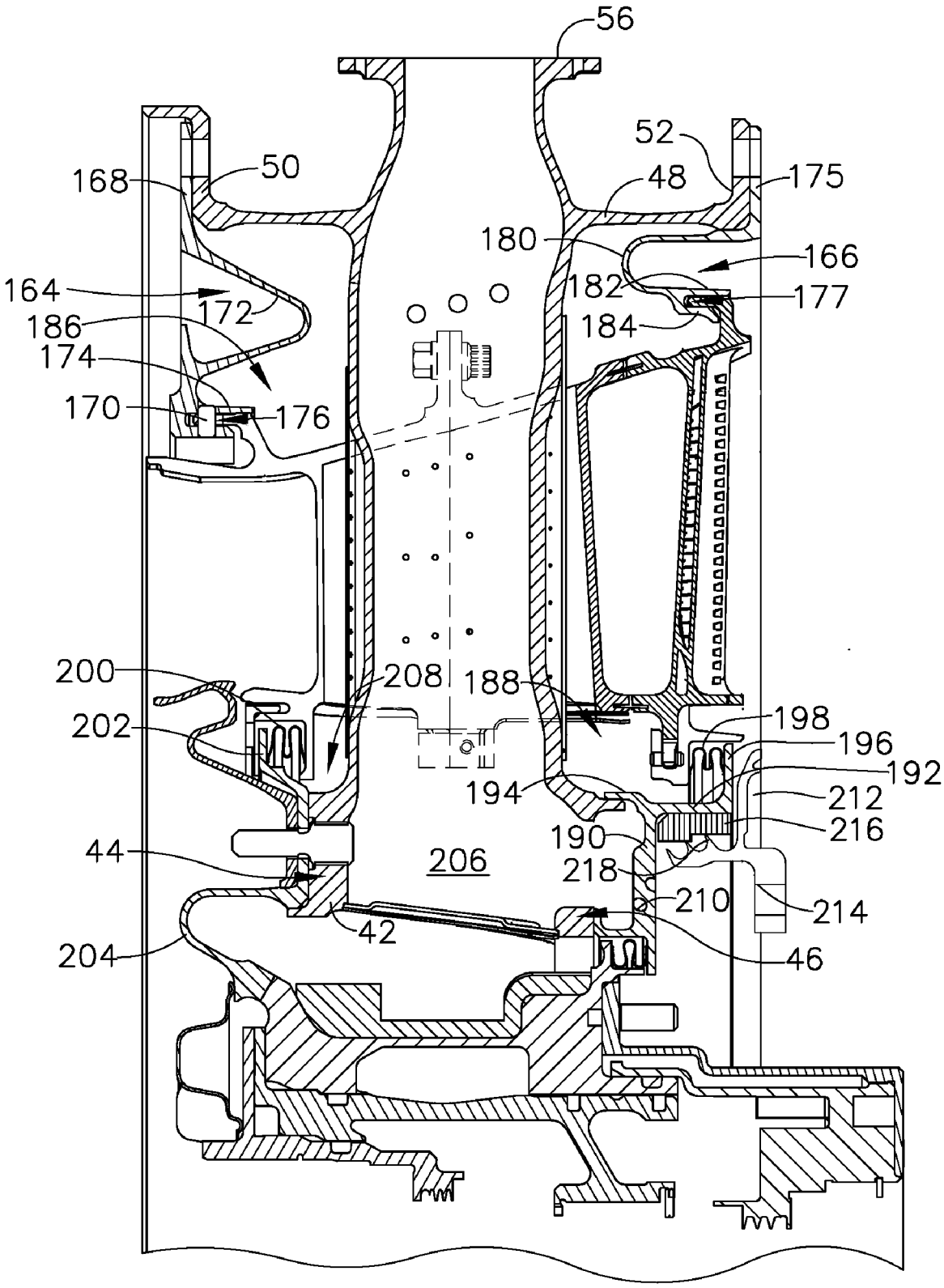
FIGS. 3A and 3B are cross-sectional views of the turbine frame assembly of FIG. 2.
Figure 3B:
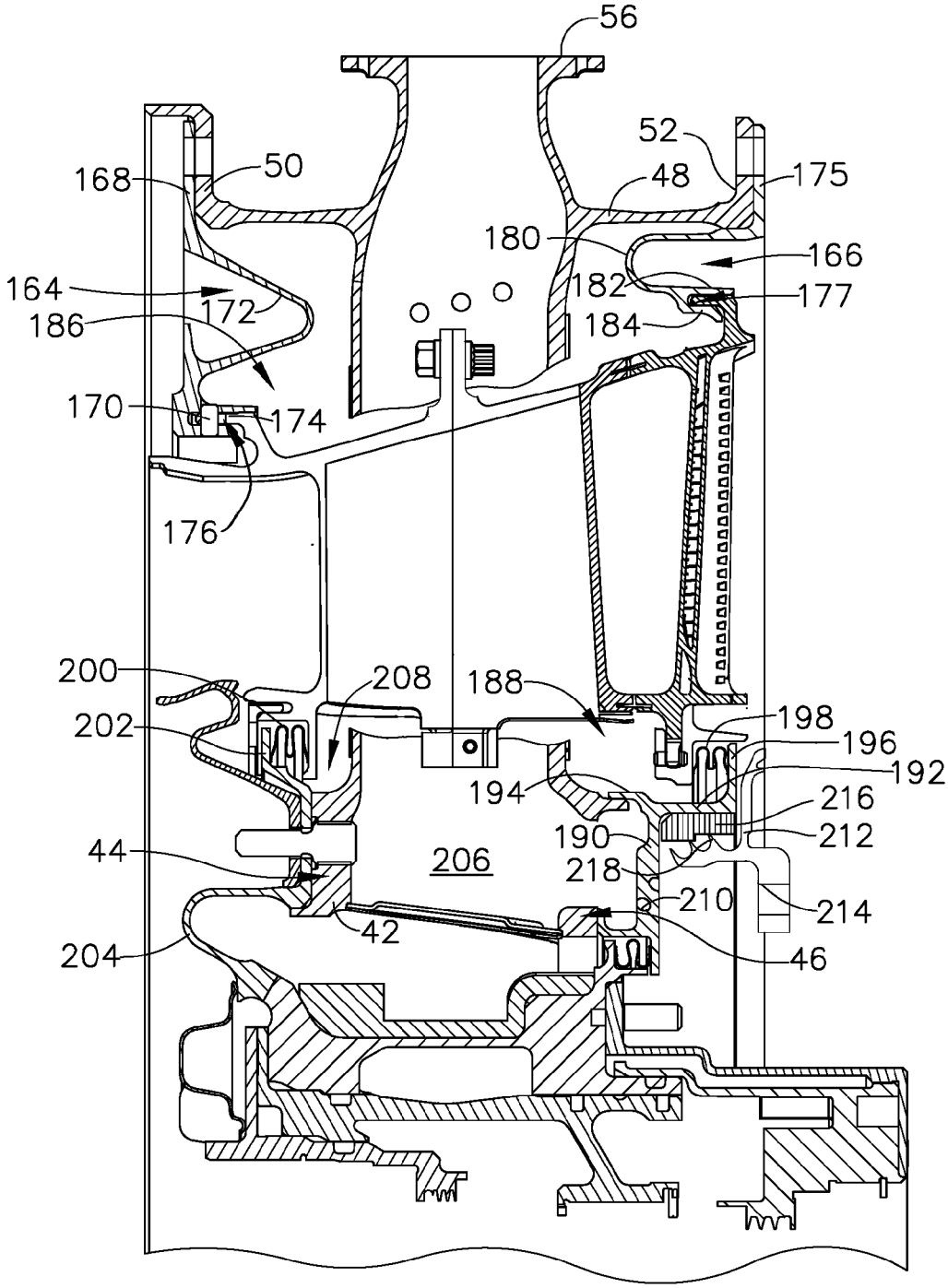
Figure 4:
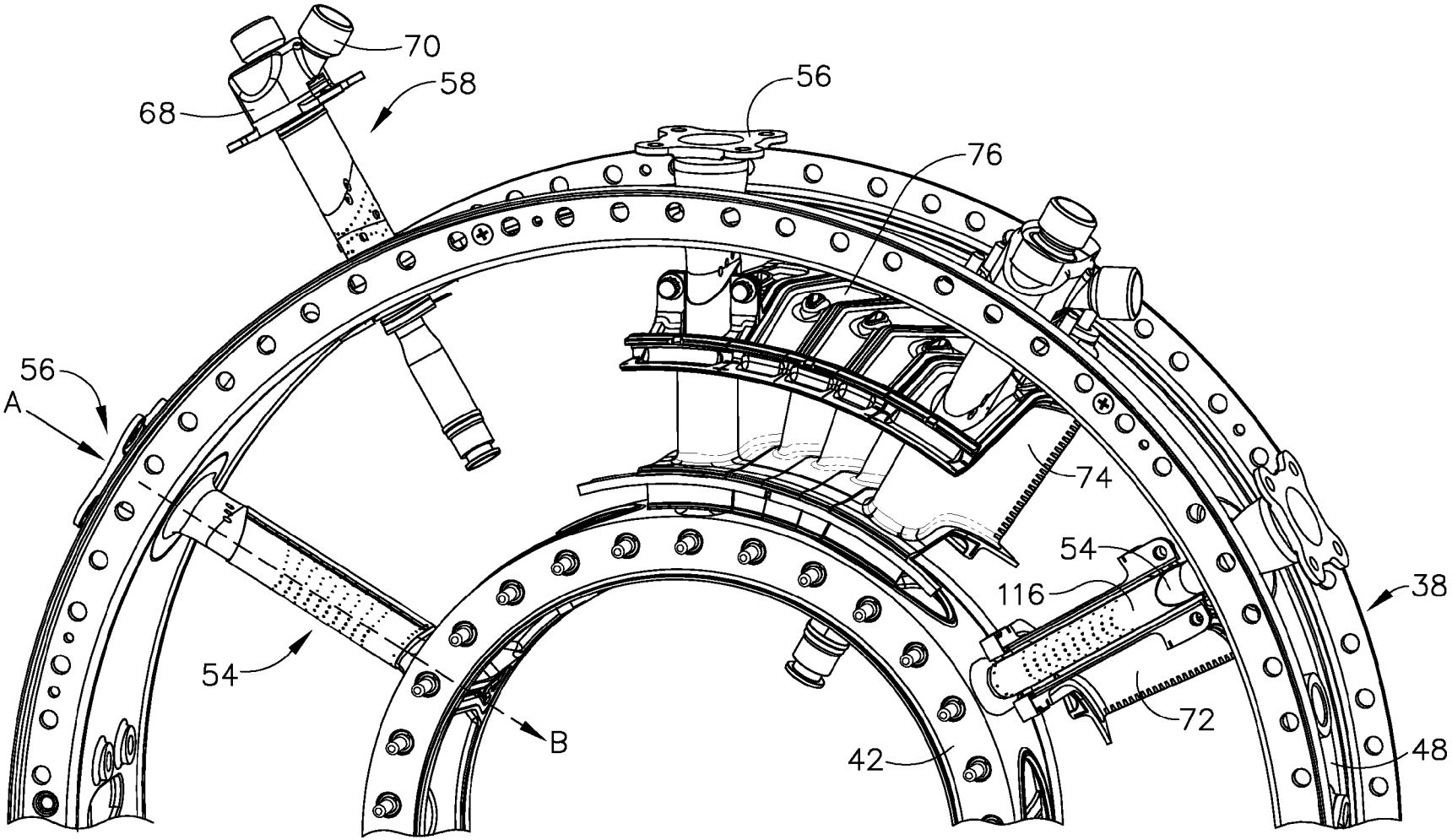
FIG. 4 is a perspective view of the turbine frame assembly in a partially-assembled condition.

FIGS. 2-4 illustrate the construction of the turbine frame assembly in more detail. The turbine frame 38 comprises an annular, centrally-located hub 42 with forward and aft faces 44 and 46, surrounded by an annular outer ring 48 having forward and aft flanges 50 and 52. The hub 42 and the outer ring 48 are interconnected by a plurality of radially-extending struts 54. In the illustrated example there are six equally-spaced struts 54. The turbine frame 38 may be a single integral unit or it may be built up from individual components. In the illustrated example it is cast in a single piece from a metal alloy suitable for high-temperature operation, such as a cobalt- or nickel-based "superalloy". An example of a suitable material is a nickel-based alloy commercially known as IN718. Each of the struts 54 is hollow and terminates in a bleed air port 56 at its outer end, outboard of the outer ring 48.

Figure 5:
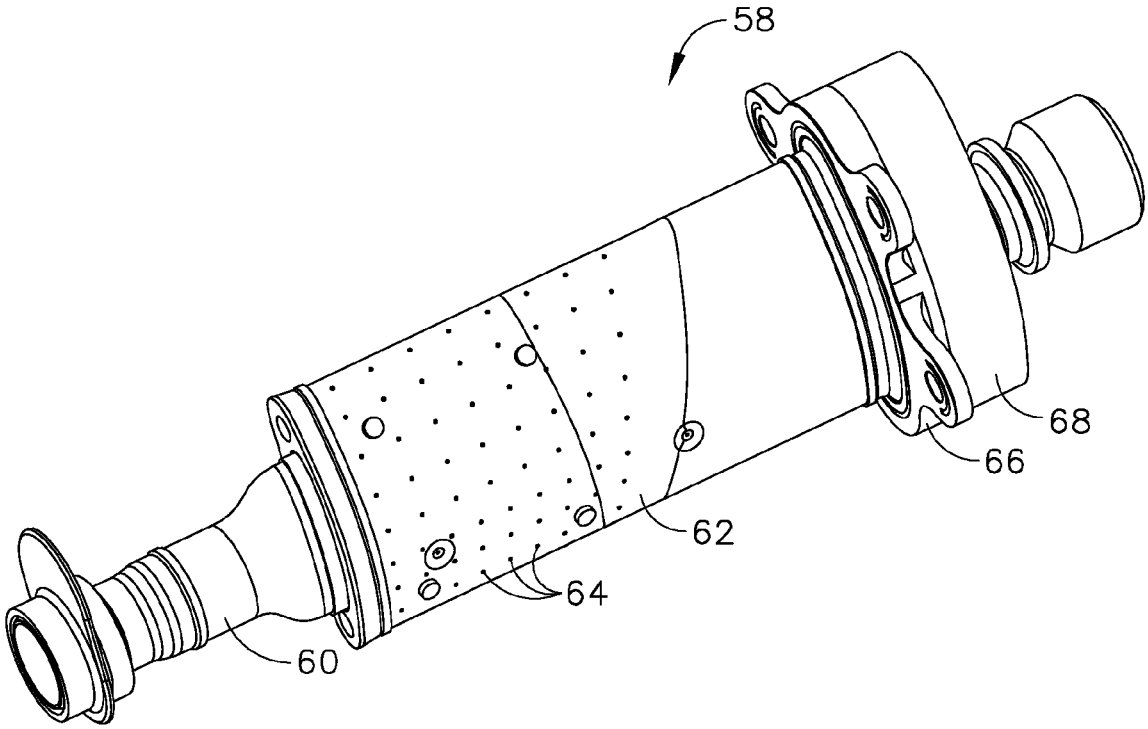
FIG. 5 is a perspective view of a service tube assembly constructed according to an aspect of the present invention.

A plurality of service tube assemblies 58 are mounted in the turbine frame 38, positioned between the struts 54, and extend between the outer ring 48 and the hub 42. In this example there are six service tube assemblies 58. As shown in FIG. 5, each service tube assembly 58 includes a hollow service tube 60 which is surrounded by a hollow housing that comprises a service tube baffle 62 pierced with impingement cooling holes 64, a mounting bracket 66, and a manifold 68 with an inlet tube 70 (see FIG. 4). The service tube assemblies 58 plug into aligned openings in the outer ring 48 and the hub 42, and are secured to the outer ring 48 using bolts passing through the mounting bracket 66.

The nozzle cascade 40 comprises a plurality of actively-cooled airfoils. In this particular example there are 48 airfoils in total. This number may be varied to suit a particular application. Some of the airfoils, in this case 12, are axially elongated and are incorporated into fairings (see FIG. 4) which protect the struts 54 and service tube assemblies 58 from hot combustion gases. Some of the fairings, in this case 6, are strut fairings 72 which are of a split configuration. The remainder of the fairings are service tube fairings 74 which are a single piece configuration. The remaining airfoils, in this case 36, are arranged into nozzle segments 76 having one or more vanes each.

Figure 6:
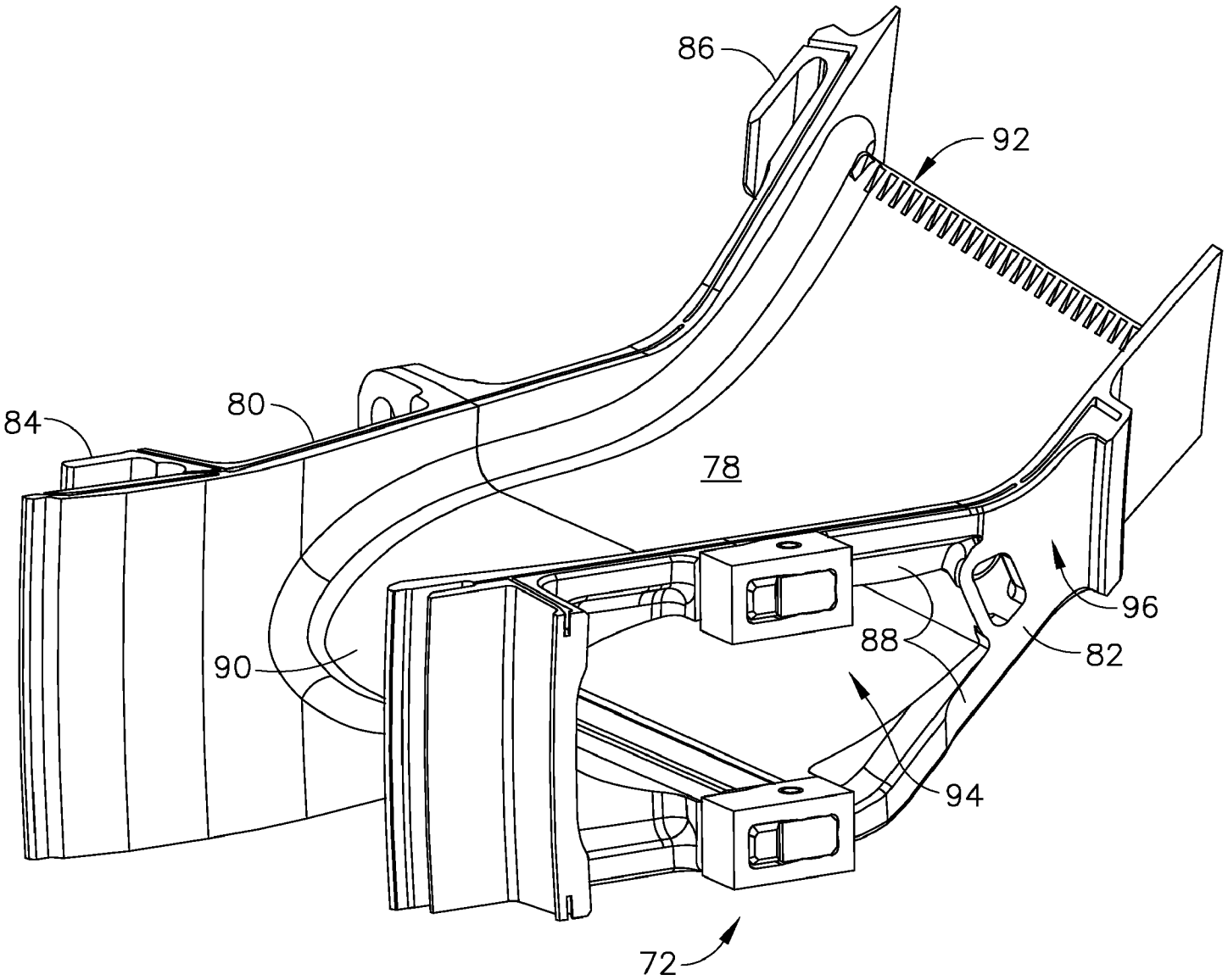
FIG. 6 is a perspective view of a strut fairing constructed according to an aspect of the present invention.

FIG. 6 shows one of the strut fairings 72 in more detail. it includes an airfoil-shaped vane 78 that is supported between an arcuate outer band 80 and an arcuate inner band 82. The inner and outer bands 82 and 80 are axially elongated and shaped so that they define a portion of the flowpath through the turbine frame 38. A forward hook 84 protrudes axially forward from the outer face of the outer band 80, and an aft hook 86 protrudes axially forward from the outer face of the outer band 80.

Figure 7:
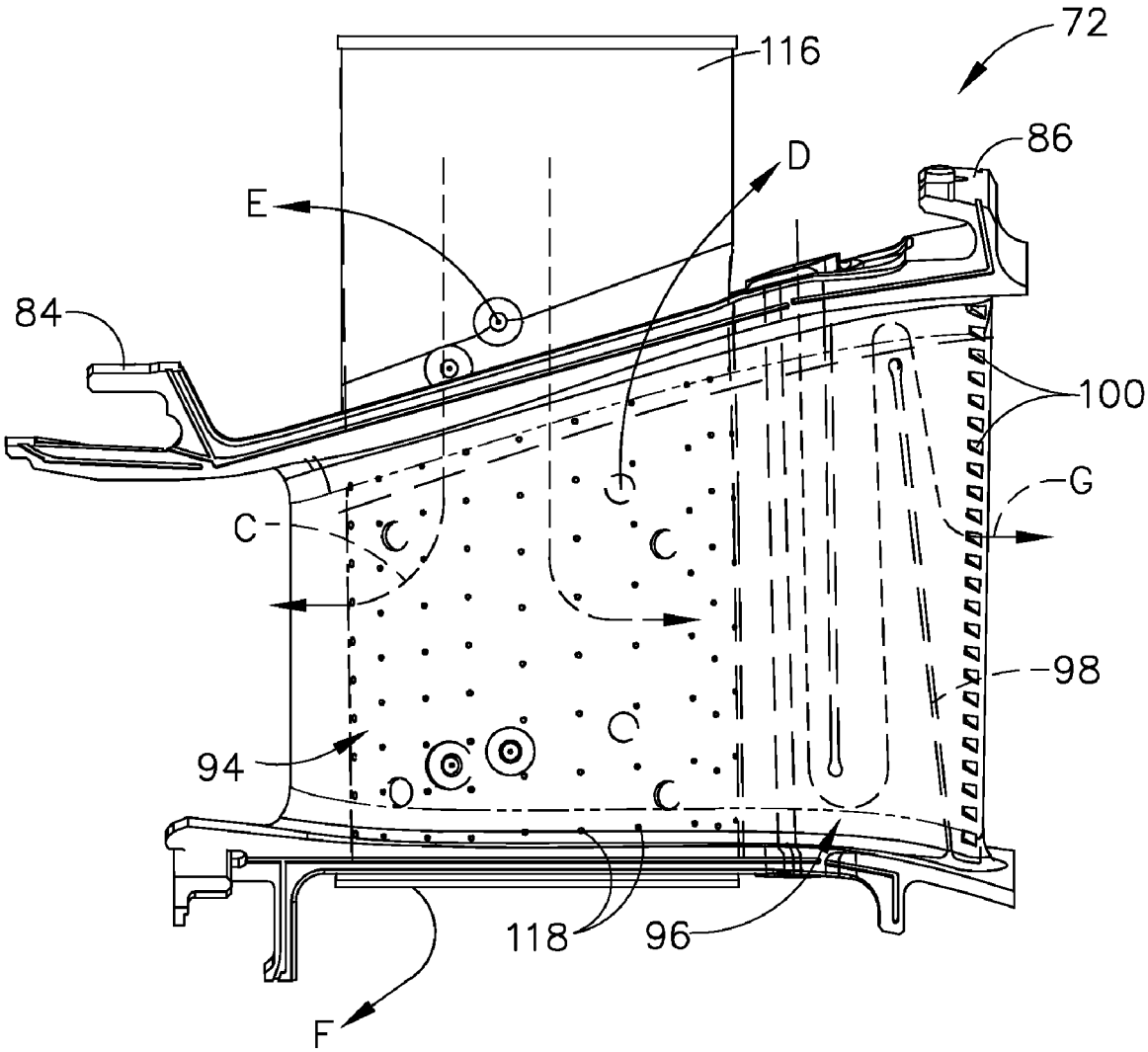
FIG. 7 is a side view of the strut fairing of FIG. 6.
Figure 8:
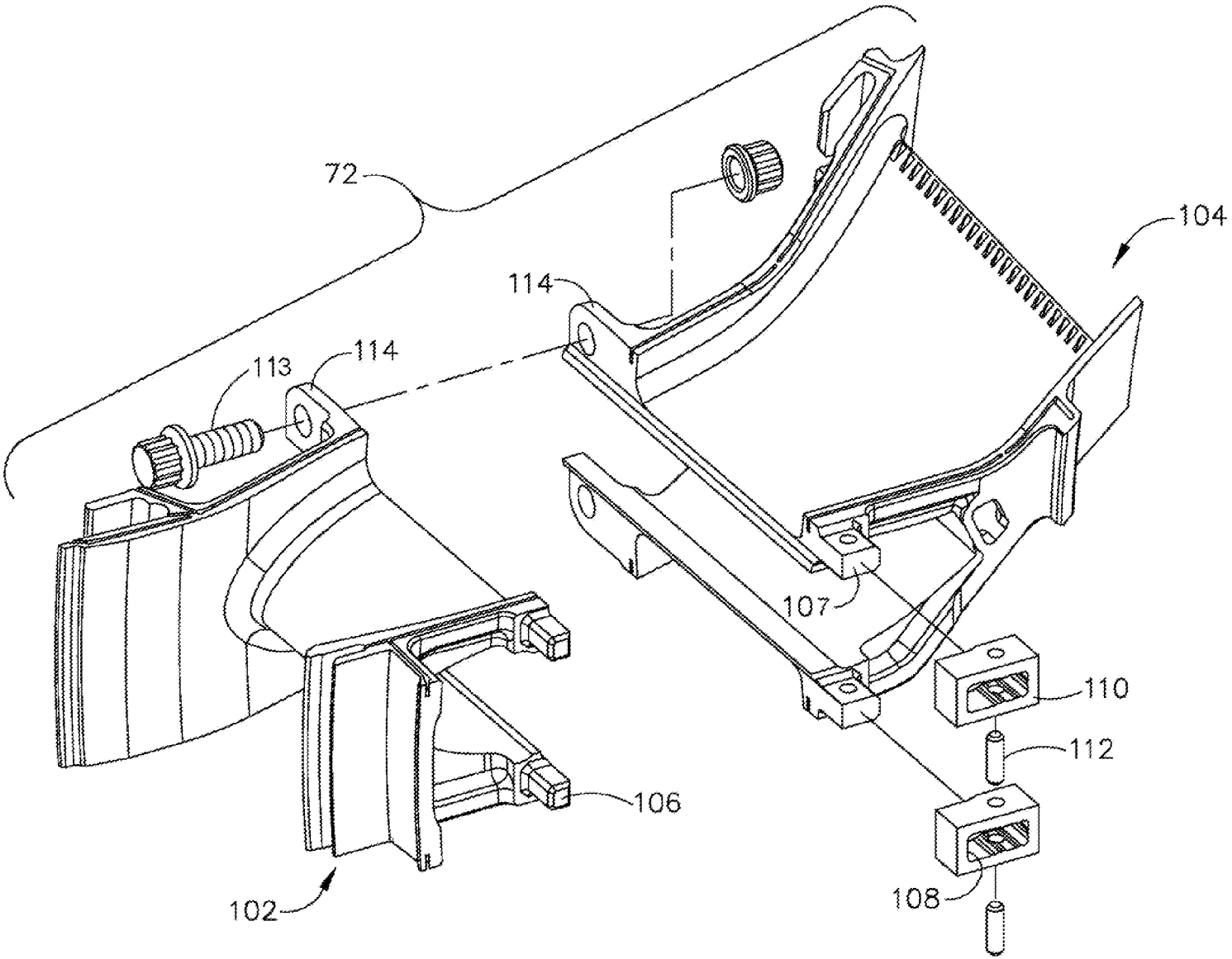
FIG. 8 is an exploded view of the strut fairing of FIG. 6.

The vane 78 is axially elongated and includes spaced-apart sidewalls 88 extending between a leading edge 90 and a trailing edge 92. The sidewalls 88 are shaped so as to form an aerodynamic fairing for the strut 54 (see FIG. 4). A forward section 94 of the vane 78 is hollow and is impingement cooled, in a manner described in more detail below. An aft section 96 of the vane 78 is also hollow and incorporates walls 98 that define a multiple-pass serpentine flowpath (see FIG. 7). A plurality of trailing edge passages 100, such as slots or holes, pass through the trailing edge 92. The components of the strut fairing 72, including the inner band 82, outer band 80, and vane 78 are split, generally along a common transverse plane, so that the strut fairing 72 has a nose piece 102 and a tail piece 104 (see FIG. 8). Means are provided for are securing the nose piece and the tail piece 102 and 104 to each other after being placed around a strut 54. In the illustrated example, the nose piece 102 and the tail piece 104 include radially-inwardly extending tabs 106 and 107, respectively, which are received in a slot 108 of a buckle 110. The buckle 110 is secured to the tabs 107, for example by brazing, and is optionally further secured by a press-fit pin 112 passing therethrough. The radially outer ends of the nose and tail pieces 102 and 104 are secured together with shear bolts 113 or other similar fasteners installed through mating flanges 114. As shown in FIGS. 4 and 7, a strut baffle 116 pierced with impingement cooling holes 118 is installed between the strut 54 and the strut fairing 72.

The nose pieces 102 and tail pieces 104 are cast from a metal alloy suitable for high-temperature operation, such as a cobalt- or nickel-based "superalloy", and may be cast with a specific crystal structure, such as directionally-solidified (DS) or single-crystal (SX), in a known manner. An example of one suitable material is a nickel-based alloy commercially known as RENE N4.

Figure 9:
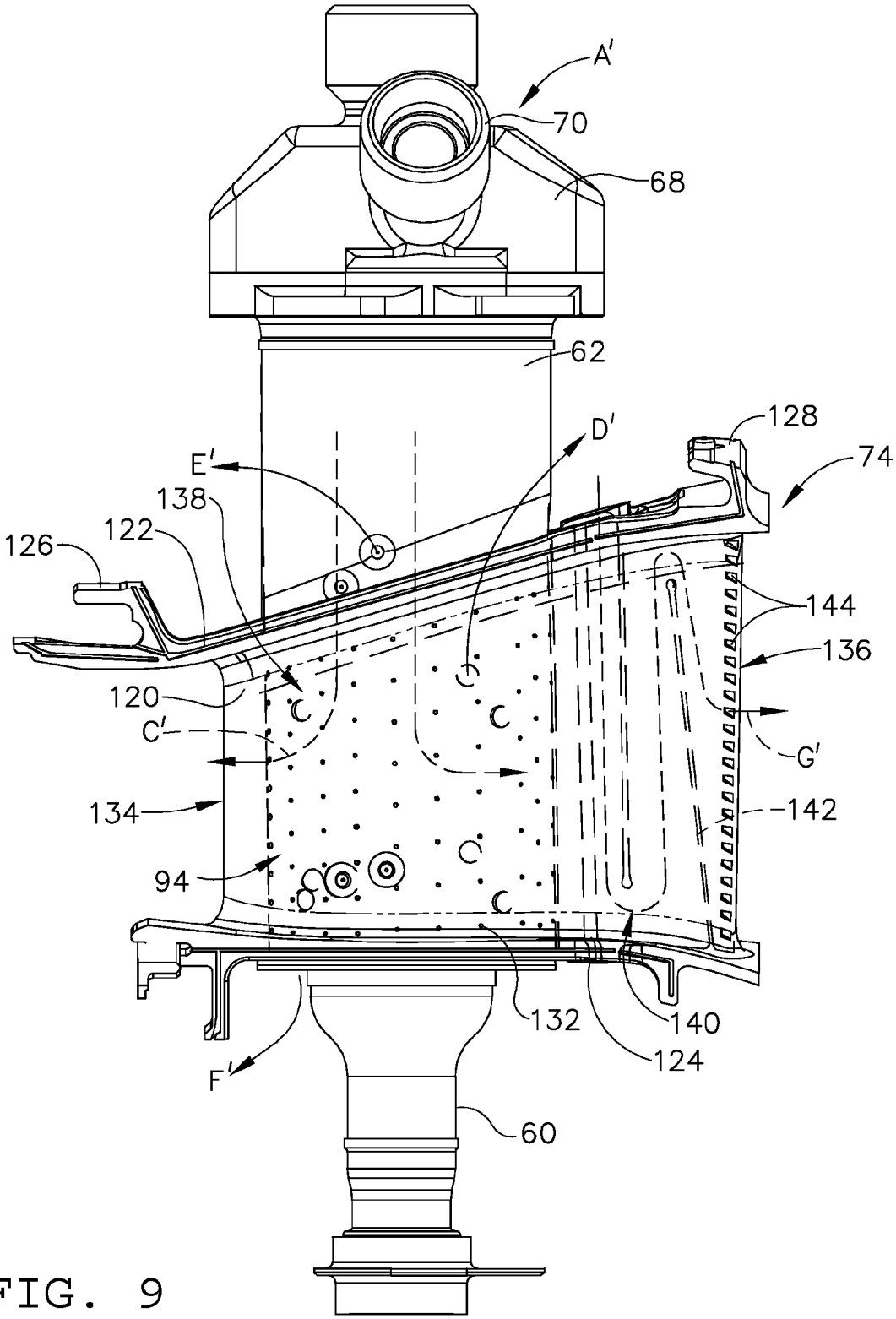
FIG. 9 is a side view of a service tube fairing.

FIG. 9 shows one of the service tube fairings 74 in more detail. Like the strut fairing 72, it includes an airfoil-shaped hollow vane 120 that is supported between an arcuate outer band 122 and an arcuate inner band 124. The inner and outer bands 124 and 122 are axially elongated and shaped so that they define a portion of the flowpath through the turbine frame 38. A forward hook 126 protrudes axially forward from the outer face of the outer band 122, and an aft hook 128 protrudes axially forward from the outer face of the outer band 122. The vane 120 is axially elongated and includes spaced-apart sidewalls 132 extending between a leading edge 134 and a trailing edge 136. The sidewalls 132 are shaped so as to form an aerodynamic fairing for the service tube assembly 58. A forward section 138 of the vane 120 is hollow and is impingement cooled, in a manner described in more detail below. An aft section 140 of the vane 120 is also hollow and incorporates walls 142 that define a multiple-pass serpentine flowpath. A plurality of trailing edge passages 144, such as slots or holes, pass through the trailing edge 136 of each vane 120. The service tube fairings 74 are cast from a suitable alloy as described for the strut fairings 72.

Figure 10:
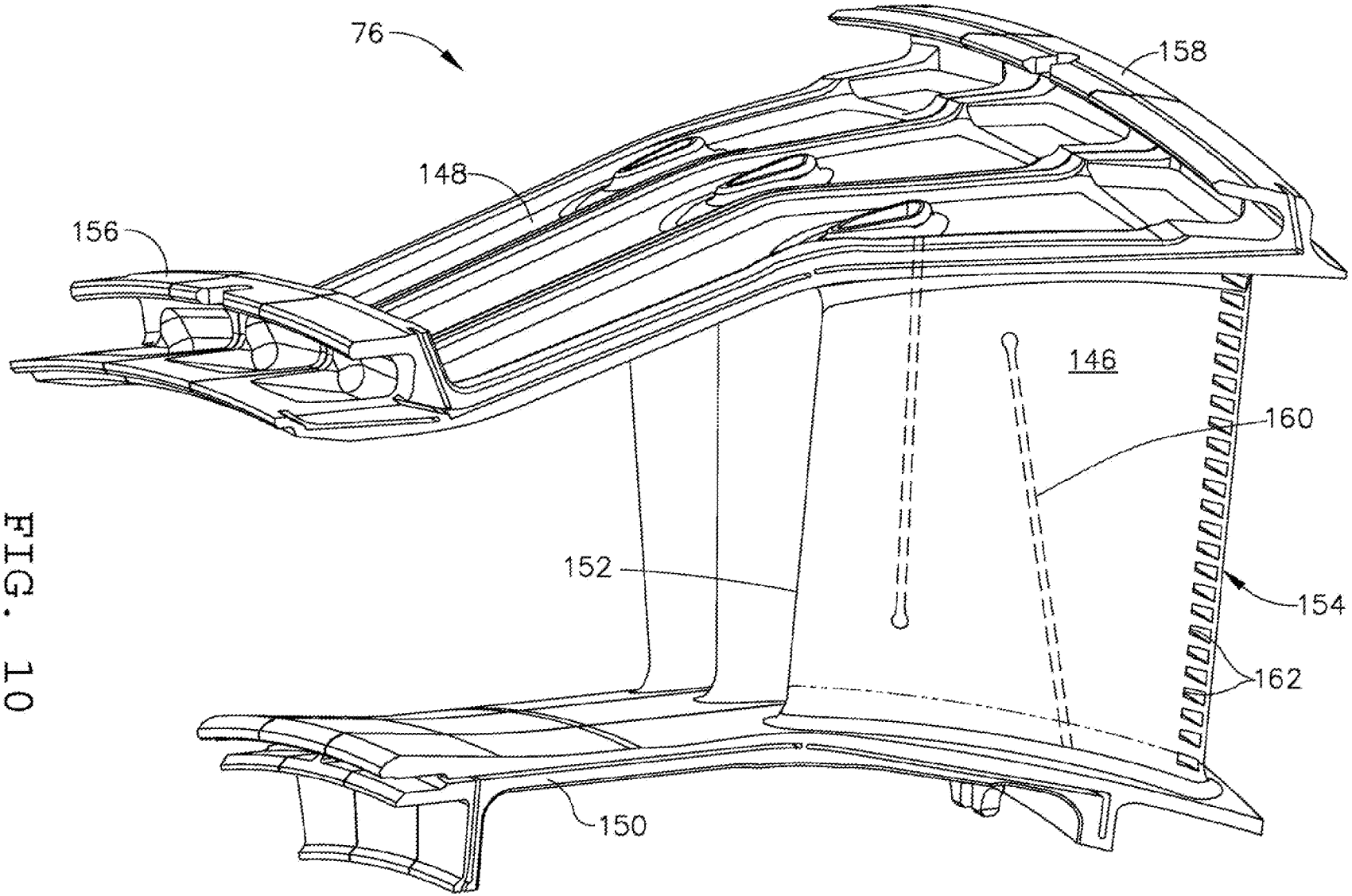
FIG. 10 is a perspective view of a nozzle segment of the turbine frame assembly.

FIG. 10 illustrates one of the nozzle segments 76 in more detail. Like the strut fairings 72 and the service tube fairings 74, each of the nozzle segments 76 includes one or more circumferentially spaced airfoil-shaped hollow vanes 146 that are supported between an arcuate outer band 148 and an arcuate inner band 150. The vanes 146 each have a leading edge 152 and a trailing edge 154, and are configured so as to optimally direct the combustion gases to downstream rotor 28 of the work turbine 24 (see FIG. 2). In the illustrated example, the nozzle segments 76 are "triplets" each incorporating three vanes 146 between the inner and outer bands 150 and 148. The outer and inner bands 148 and 150 define the outer and inner radial flowpath boundaries, respectively, for the hot gas stream flowing through the nozzle cascade 40. The inner and outer bands 150 and 148 are axially elongated and shaped so that they also define the flowpath through the turbine frame 38. A forward hook 156 protrudes axially forward from the outer face of the outer band 148, and an aft hook 158 protrudes axially forward from the outer face of the outer band 148.

The vanes 146 are hollow and incorporate walls 160 that define a multiple-pass serpentine flowpath. a plurality of trailing edge passages 162, such as slots or holes, pass through the trailing edge 154 of each vane 146. The nozzle segments 76 are cast from a suitable alloy as described for the strut fairings 72.

As shown in FIGS. 2 and 3, the strut fairings 72, service tube fairings 74, and nozzle segments 76 are all supported by forward and aft hangers 164 and 166 which are fastened to the forward and aft flanges 50 and 52 of the turbine frame 38, respectively, for example using bolts or other suitable fasteners.

The forward nozzle hanger 164 is generally disk-shaped and includes an outer flange 168 and an inner flange 170, interconnected by an aft-extending arm 172 having a generally "V"-shaped cross-section. The inner flange 170 defines a mounting rail 174 with a slot 176 which accepts the forward hooks 84, 126, and 156 of the strut fairings 72, service tube fairings 74, and nozzle segments 76, respectively. The outer flange 168 has bolt holes therein corresponding to bolt holes in the forward flange 50 of the turbine frame 38. The forward nozzle hanger 164 supports the nozzle cascade 40 radially in a way that allows compliance in the axial direction.

The aft nozzle hanger 166 is generally disk-shaped and includes an outer flange 175 and an inner flange 177, interconnected by forward-extending arm 180 having a generally "U"-shaped cross-section. The inner flange 177 defines a mounting rail 182 with a slot 184 which accepts the aft hooks 86, 128, and 158 of the strut fairings 72, service tube fairings 74, and nozzle segments 76, respectively. The outer flange 175 has bolt holes therein corresponding to bolt holes in the aft flange 52 of the turbine frame 38. The aft nozzle hanger 166 supports the nozzle cascade 48 radially while providing restraint in the axial direction.

When assembled, the outer bands 80, 122, and 148 of the strut fairings 72, service tube fairings 74, and nozzle segments 76 cooperate with the outer ring 48 of the turbine frame 38 to define an annular outer band cavity 186 (see FIG. 3).

Figure 11:
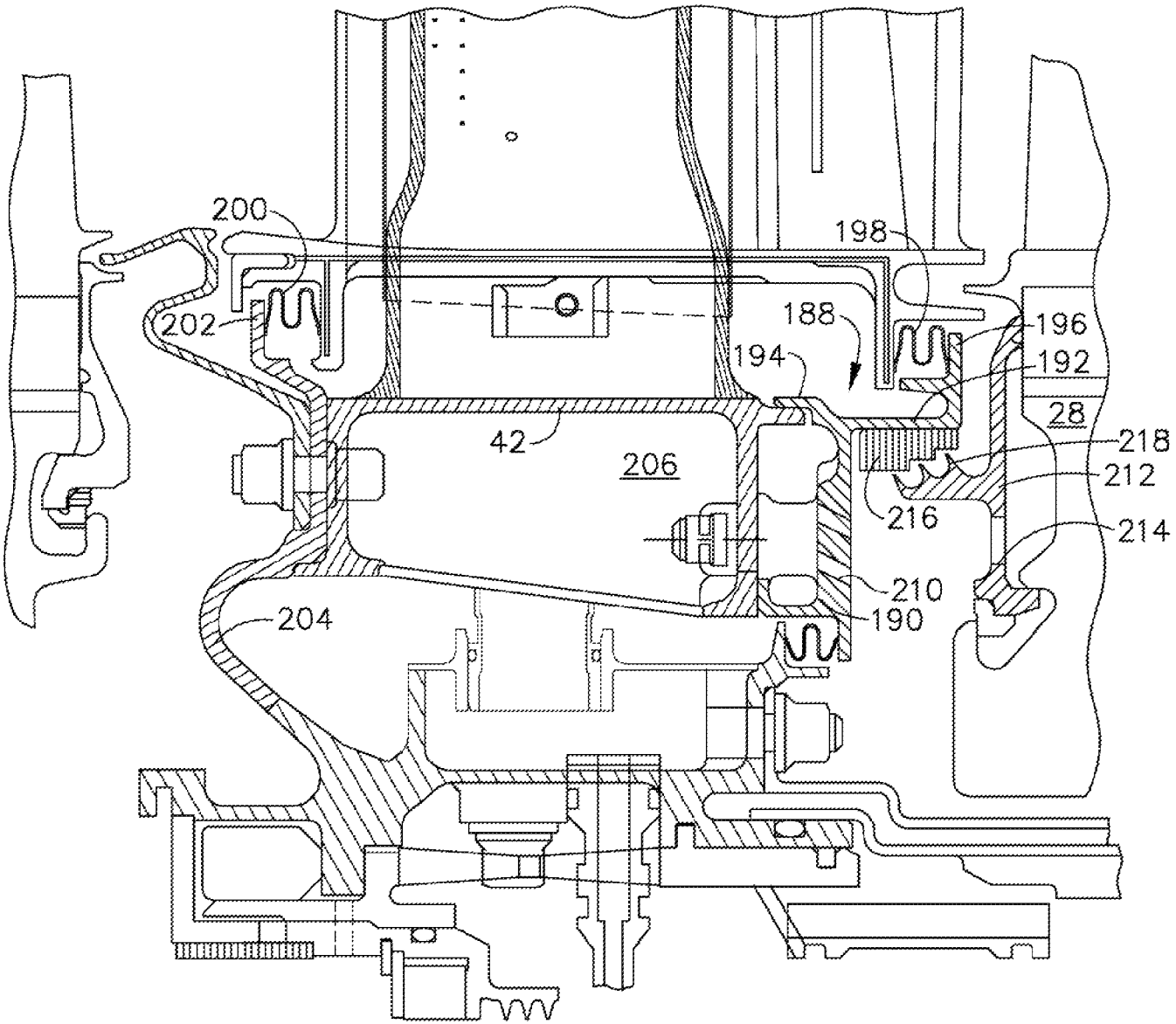
FIG. 11 is an enlarged cross-sectional view of a portion of the turbine frame assembly.

As best seen in FIG. 11, an annular outer balance piston (OBP) seal 188 is attached to the aft face of the hub 42, for example with bolts or other suitable fasteners. The OBP seal 188 has a generally "L"-shaped cross-section with a radial arm 190 and an axial arm 192. A forward sealing lip 194 bears against the hub 42, and an aft, radially-outwardly-extending sealing lip 196 captures an annular, "M"-shaped seal 198 against the nozzle cascade 40. A similar "M"-shaped seal 200 is captured between the forward end of the nozzle cascade 40 and another sealing lip 202 on an stationary engine structure 204. Collectively, the hub 42 and the OBP seal 188 define an inner manifold 206 which communicates with the interior of the hub 42. Also, the inner bands 82, 124, and 150 of the strut fairings 72, service tube fairings 74, and nozzle segments 76 cooperate with the hub 42 of the turbine frame 38, the OBP seal 188, and the seals 198 and 200 to define an annular inner band cavity 208. One or more cooling holes 210 pass through the radial arm 190 of the OBP seal 188. In operation, these cooling holes 210 pass cooling air from the hub 42 to an annular seal plate 212 mounted on a front face of the downstream rotor 28. The cooling air enters a hole 214 in the seal plate 212 and is then routed to the rotor 28 in a conventional fashion.

The axial arm 192 of the OBP seal 188 carries an abradable material 216 (such as a metallic honeycomb) which mates with a seal tooth 218 of the seal plate 212.

Referring to FIGS. 4, 7, and 9, cooling of the turbine frame assembly is as follows. Cooling air bled from a source such as the compressor 12 (see FIG. 1) is fed into the bleed air ports 56 and down through the struts 54, as shown by the arrow "A". A portion of the air entering the struts 54 passes all the way through the struts 54 and to the hub 42, as shown at "B". It then passes to the inner manifold 206 and subsequently to the downstream turbine rotor 28, as described above.

Another portion of the air entering the struts 54 exits passages in the sides of the struts 54 and enters the strut baffles 116. One portion of this flow exits impingement cooling holes in the strut baffles 116 and is used for impingement cooling the strut fairings 72, as shown by arrows "C" (see FIG. 7). After impingement cooling, the air passes to the outer band cavity 186, as shown at "D". Another portion of air exits the strut baffles 116 and enters the outer band cavity 186 directly, as shown by arrows "E". Finally, a third portion of the air from the strut baffles 116 exits the between the strut baffle 116 and the strut 54 and purges the inner band cavity 208 (see arrow "F").

As shown in FIG. 9, a similar cooling air flow pattern is implemented for the service tube assemblies 58 and cooling of the service tube fairings 74, the main difference being that cooling air is supplied to the service tube baffles 62 through the inlet tubes 70, as shown by the arrows "A'". The remainder of the flows, indicated by arrows C', D', E', and F', are substantially identical to the flows A-F described above.

Air from the outer band cavity 186, which is as combination of purge air and post-impingement flows denoted D, D', E, and E' in FIGS. 7 and 9, enters the serpentine passages in the aft sections of the vanes 78, 120, as shown at arrows "G" and "G'" in FIGS. 7 and 9. These patterns are also exemplary of the flow pattern in the serpentine passages of the vanes 146. It is then used therein for convective cooling in a conventional manner and subsequently exhausted through the trailing edge cooling passages.

The turbine frame assembly described above has multiple advantages over prior art designs. The actively cooled and segmented nozzle cascade 40 protects the turbine frame 38 and enables straddle mounting of the gas generator rotor at higher cycle temperatures. The result is good rotor stability and minimal maneuver closures. The actively cooled and segmented nozzle cascade 40 also enables higher operating temperatures while utilizing traditional materials and multi-vane segment construction. The integration of the turbine frame 38 and the nozzle cascade 40 reduces the flowpath length and aerodynamic scrubbing losses through the engine 10, improving engine performance.

The actively cooled and segmented nozzle cascade 40 improves parts life at higher cycle temperatures, and the turbine frame configuration provides cooling air for improved durability, and allows for cooling air supply to actively cool the work turbine 24.

The integrated turbine frame 38 and nozzle cascade 40 reduce engine length, enabling installation into more compact nacelles, and reduces engine weight. The nozzle cascade 40 can be easily assembled and can be replaced without disassembly of the turbine frame 38. The turbine frame 38 is one piece without bolt-in struts. The service tube assemblies 58 are "plug-ins" that are replaceable without engine disassembly.

Finally, the use of a one-piece turbine frame 38 with the integrated nozzle cascade 40 eliminates the cost of match-machining and bolting frame components and precision-contour-grinding of overlapped liner and fairing flowpath panels which is required with conventional designs.

The foregoing has described a turbine frame assembly for a gas turbine engine. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only and not for the purpose of limitation, the invention being defined by the claims.

What is claimed is:

1. A turbine frame assembly for a gas turbine engine, comprising:

(a) a turbine frame including:
(i) an outer ring;
(ii) a hub;
(iii) a plurality of struts extending between the hub and the outer ring;
(b) a plurality of two-piece strut fairing fairings, each surrounding one of the struts, each strut fairing comprising:
(i) an inner band;
(ii) an outer band; and
(iii) an airfoil-shaped vane extending between the inner and outer bands; and
(c) a plurality of nozzle segments disposed between the outer ring and the hub and disposed circumferentially between adjacent ones of the struts, each nozzle segment being an integral metallic casting including:
(i) an arcuate outer band;
(ii) an arcuate inner band; and
(iii) an airfoil-shaped vane.

2. The turbine frame assembly of claim 1 wherein the outer ring, the hub, and the struts are a single integral casting.

3. The turbine frame assembly of claim 1 further comprising a strut baffle pierced with impingement cooling holes disposed between each of the struts and the vane of the associated strut fairing.

4. The turbine frame assembly of claim 1 wherein the strut fairing is split along a generally transverse plane into a nose piece and a tail piece.

5. The turbine frame assembly of claim 1 wherein each of the vanes of the strut fairings includes walls defining a serpentine flow path therein, the serpentine flow path in fluid communication with at least one trailing edge passage disposed at a trailing edge of the vane.

6. The turbine frame assembly of claim 1 wherein each of the vanes of the nozzle segments includes walls defining a serpentine flow path therein, the serpentine flow path in fluid communication with at least one trailing edge passage disposed at a trailing edge of the vane.

7. The turbine frame assembly of claim 1 further comprising:
(a) a plurality of service tube assemblies each defining a hollow passage extending between the hub and the outer ring; and
(b) a service tube fairing surrounding each of the service tube assemblies, comprising:
(i) an arcuate outer band;
(ii) an arcuate inner band; and
(iii) an airfoil-shaped vane;
wherein the vane defines a continuous fairing around the service tube assembly.

8. The turbine frame assembly of claim 7 wherein each of the service tube assemblies comprises:
(a) an elongated, hollow service tube; and
(b) a service tube baffle surrounding the service tube which is pierced with a plurality of impingement cooling holes.

9. The turbine frame assembly of claim 7 wherein each of the vanes of the service tube fairings includes walls defining a serpentine flow path therein, the serpentine flow path in fluid communication with at least one trailing edge passage disposed at a trailing edge of the vane.

10. The turbine frame assembly of claim 7 wherein the strut fairings, service tube fairings, and nozzle segments are secured to the turbine frame by spaced-apart annular forward and aft nozzle hangers which engage the outer bands of the strut fairings, service tube fairings, and nozzle segments.

11. The turbine frame assembly of claim 1 further comprising an annular seal member disposed on an aft face of the hub of the turbine frame, the seal cooperating with the hub to define an inner manifold, and having at least one cooling passage formed therein.

12. A method of cooling a turbine frame assembly of a gas turbine engine, comprising:
(a) providing a turbine frame comprising:
(i) an outer ring;
(ii) a hub; and
(iii) at least one strut extending between the hub and the outer ring and surrounded by a strut baffle pierced with impingement cooling holes and an airfoil-shaped strut fairing;
(b) providing a nozzle cascade disposed between the hub and the outer ring, comprising a plurality of airfoil-shaped vanes carried between segmented annular inner and outer bands;
(c) directing a first portion of cooling air radially inward through the struts to the hub;
(d) passing the first portion of cooling air to an inner manifold located within the hub;
(e) passing the first portion of cooling air from the manifold to a turbine rotor disposed downstream of the hub;
(f) passing a second portion of cooling air from the strut to the strut baffle; and
(g) impinging the second portion of cooling air through the impingement cooling holes onto the strut fairing.

13. The method of claim 12 further wherein an annular seal member is disposed on an aft face of the hub of the turbine frame, the seal cooperating with the hub to define the inner manifold, and having at least one cooling passage formed therein.

14. The method of claim 12 wherein the turbine frame assembly further comprises:
(a) providing a plurality of service tube assemblies extending from the outer ring to the hub, each including:
(i) an elongated, hollow service tube;
(ii) a service tube baffle surrounding the service tube which is pierced with a plurality of impingement cooling holes; and
(iii) an airfoil-shaped strut fairing surrounding the service tube baffle, the method further comprising:
(b) passing cooling air from the service tube to the service tube baffle; and
(c) impinging cooling air through the impingement cooling holes onto the service tube fairing.

15. The method of claim 12 further wherein an annular outer band cavity is defined between the nozzle cascade and the outer ring, the method further comprising:
(a) directing cooling air into the outer band cavity;
(b) flowing the cooling air through a serpentine flowpath in each of the vanes; and
(c) exhausting the cooling air from trailing edge cooling passages in each of the vanes.

16. The method of claim 12 further wherein an annular inner band cavity is defined between the nozzle cascade and the hub, the method further comprising directing cooling air which has impinged onto the strut fairing into the inner band cavity.

* * * * *